United States Patent [19]

Tarmann et al.

[11] 4,037,644

[45] July 26, 1977

[54] PROCESS FOR CASTING STEEL INGOTS UNDER A VACUUM

[75] Inventors: Rainer Tarmann; Walter Hopf, both of Kapfenberg, Austria

[73] Assignee: Vereinigte Edelstahlwerke Aktiengesellschaft (VEW), Vienna, Austria

[21] Appl. No.: 613,859

[22] Filed: Sept. 16, 1975

[30] Foreign Application Priority Data

Sept. 23, 1974 Austria ..... 7609/74

[51] Int. Cl.[2] ..... B22D 27/16; B22D 7/10

[52] U.S. Cl. ..... 164/61; 164/123; 164/253

[58] Field of Search ..... 164/61, 123, 120, 133, 164/256, 258, 55, 56, 65, 253; 141/8, 70

[56] References Cited

U.S. PATENT DOCUMENTS

| | | | |
|---|---|---|---|
| 1,719,542 | 7/1929 | Gathmann | 164/123 |
| 2,825,945 | 3/1958 | Ulrech et al. | 164/258 X |
| 3,182,359 | 5/1965 | Gero | 164/55 X |
| 3,185,187 | 5/1965 | Luther | 141/8 X |
| 3,236,636 | 2/1966 | Finkl | 164/61 X |

FOREIGN PATENT DOCUMENTS

| | | | |
|---|---|---|---|
| 448,398 | 3/1968 | Switzerland | 164/256 |

*Primary Examiner*—Ronald J. Shore
*Assistant Examiner*—Gus T. Hampilos
*Attorney, Agent, or Firm*—Burns, Doane, Swecker & Mathis

[57] ABSTRACT

A process for casting steel ingots, wherein the steel from a ladle is cast under vacuum through the lid of a container which can be evacuated, into a mould, and wherein covering powder or anti-piping compound, respectively, is evenly applied upon the surface of the molten steel in the mould while the vacuum is maintained.

2 Claims, 2 Drawing Figures

PROCESS FOR CASTING STEEL INGOTS UNDER A VACUUM

Figure 1:
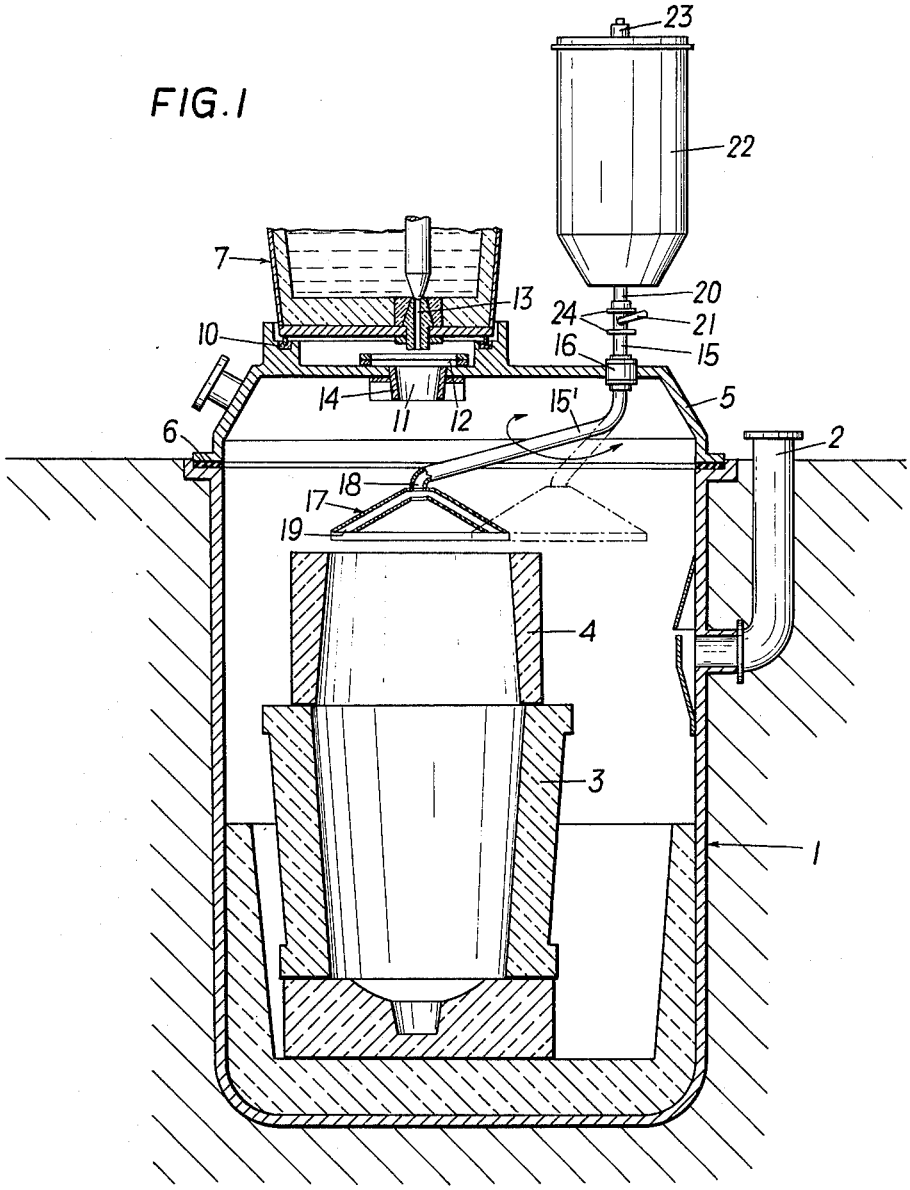

The invention relates to a process of casting steel ingots, wherein the steel from a ladle is cast under vacuum into a mould through the lid of a container that can be evacuated.

In known processes of this kind, after the casting has been finished, the vacuum is lifted, the ladle is removed and the lid is taken from the container. This procedure requires a longer period of time which causes the surface of the cast ingot in the mould to solidify partially, i.e. in the form of an edge ring, before it is possible to cover the ingot, i.e. to apply a layer of covering powder or anti-piping compound, respectively, in order to seal the ingot against the atmosphere. The weight of the covering powder or anti-piping compound, respectively, and tensions arising during the solidification in this known working method have the negative effect that parts of the permaturely solidified edge ring break out or off, respectively, and settle in the molten core of the ingot. These parts that break out form clusters with the anti-piping compound, form inclusions and cause a deterioration of the quality of the cast product.

The invention aims at preventing these disadvantages and difficulties and has as its object to provide a process and an apparatus for carrying out this process which enables a covering of the cast ingot by exploiting all of the available means of casting technology, before its surface partially solidifies and before the quality is negatively influenced. In the process of the above-mentioned kind this object is achieved in that, after the casting has been finished, covering powder or anti-piping compound, respectively, is introduced into the mould hood and is uniformly applied upon the surface of the molten steel while the vacuum is maintained.

Advantageously, the covering powder or anti-piping compound, respectively, is sucked into the mould hood under partial ventilation.

According to German Auslegeschrift 1,187,347, e.g., in the production of cast ingots it is known to subject the steel to a reduced-pressure-treatment and to add deoxidizing agents during the casting and/or solidifying, the covering, however, has been effected without exception after the reduced-pressure-treatment had been stopped.

Furthermore, the invention comprises an apparatus for carrying out this process, with a container which can be evacuated and which contains a mould, wherein a casting ladle is gas-tightly placed on the lid of the container and the ladle lip is aligned with an opening in the lid of the container; it is characterised in that in the lid of the container a pipe socket is rotatably and vacuum-tightly inserted which inside of the container is connected to a supply pipe that is adjustable to the mould cavity and outside of the container is connected to a supply container for covering powder or anti-piping compound, respectively, which supply container is provided with a locking element.

According to a preferred embodiment, the supply container for the covering powder or anti-piping compound, respectively, is provided with a ventilation valve, at whose actuation covering powder or anti-piping compound, respectively, is sucked into the mould cavity through the supply pipe.

Figure 2:
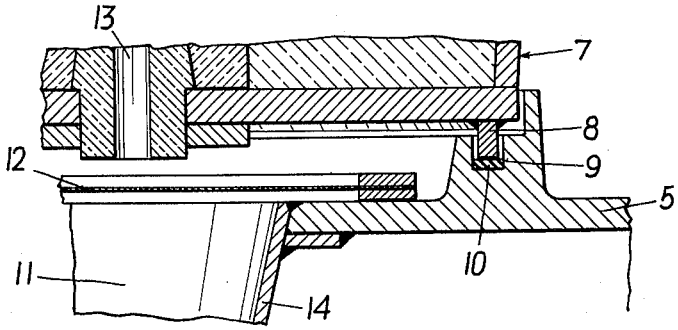

The invention shall now be described by way of an example and with reference to the accompanying drawings, wherein FIG. 1 is a vertical section through the apparatus, and FIG. 2 is a detail.

With 1 a container is denoted which can be evacuated and which is connected via an evacuation conduit 2 to a pump (not shown). In the container a mould 3 is inserted which, in its upper part, has a hood 4. The container 1 which can be evacuated is covered with a lid 5 so as to be vacuum-tight, wherein the sealings are denoted with 6. Onto the lid 5 of the container a casting ladle 7 is placed which, by means of a ring-shaped key 8 provided on its bottom, engages with a ring-shaped slot 9 of the lid and is sealed with a rubber sealing 10. In the middle of the lid there is a central opening 11, at which a membrane sealing 12 of aluminum foil is fixed. Above the central opening 11 there is the lip 13 of the ladle. With 14 a funnel-shaped member is denoted. In the lid 5, according to the invention a pipe socket 15 is inserted in a rotatable hinge 16, this rotatable hinge being vacuum-tight relative to the lid 5. The pipe socket 15 is connected to a supply conduit 15' towards the inside which ends in a bell-shaped distributor 17. This bell-shaped distributor has a central outlet 18 and an annular outlet 19. Outside of the container, the pipe socket 15 is connected via a connecting conduit 20 that contains a locking element 21 with a supply funnel 22 which is closed on its top and has a ventilation valve 23. With 24 quick locks are denoted which serve for a quick removal of the supply funnel 22.

The apparatus functions in the following way: a casting ladle is brought into position on the evacuated container. After the opening of the lip, the steel jet penetrates the aluminum membrane and flows into the mould. After the casting has been finished, the ladle lip is closed, and while the vacuum is maintained, the supply conduit 15' with its hood-shaped distributor 17 is pivoted to the mould cavity. While maintaining the vacuum, the locking element 21 is opened to the desired extent and by actuating the ventilation valve the covering powder or anti-piping compound, respectively, is sucked through the supply conduit 15' and the bell-shaped distributor 17 into the mould hood and is evenly distributed on the liquid head of the steel. After the covering has been effected, the vacuum in the container is lifted and then the ladle and the lid are removed.

We claim:

1. In a process of casting steel ingots which utilizes a ladle for carrying molten steel, a mould container having a lid, said lid being adapted to pass molten steel therethrough, said container capable of being evacuated, and a mold disposed within said container, said mould having a hood thereover, said process comprising the step of casting molten steel from said ladle into said mould under a vacuum, and thereafter applying an anti-piping powder onto the surface of molten steel, the improvement comprising the steps of:

maintaining said vacuum after said casting step is finished, and introducing the anti-piping powder into said hood and applying it uniformly onto the surface of the molten steel while continuing to maintain said vacuum.

2. A process as set forth in claim 1, wherein the anti-piping powder is introduced into the hood of the mould by being sucked in under partial ventilation.

* * * * *